US005691095A

United States Patent [19]

Shinzo et al.

[11] Patent Number: 5,691,095

[45] Date of Patent: Nov. 25, 1997

[54] TONER FOR DEVELOPING ELECTROSTATIC LATENT IMAGE AND PROCESS FOR PRODUCING THE SAME

[75] Inventors: Kinji Shinzo; Hideki Watanabe; Seiichi Uno; Nansei Tashiro, all of Chiba; Minoru Nomura, Saitama, all of Japan

[73] Assignee: Dainippon Ink and Chemicals, Inc., Tokyo, Japan

[21] Appl. No.: 568,688

[22] Filed: Dec. 7, 1995

[30] Foreign Application Priority Data

Dec. 9, 1994 [JP] Japan ..... 6-306110

[51] Int. Cl.[6] ..... G03G 9/087

[52] U.S. Cl. ..... 430/106; 430/137

[58] Field of Search ..... 430/106, 109, 430/110, 137

[56] References Cited

U.S. PATENT DOCUMENTS 5,342,724 8/1994 Wilson ..... 430/109

5,346,792 9/1994 Kobayashi et al. ..... 430/109

FOREIGN PATENT DOCUMENTS 3-221137 9/1991 Japan .

4-303849 10/1992 Japan .

*Primary Examiner*—John Goodrow

*Attorney, Agent, or Firm*—Armstrong, Westerman, Hattori McLeland & Naughton

[57] ABSTRACT

A toner containing at least a colorant and a resin, in which the resin is a polyester resin having a total acid radical content of 2 to 50 mg equivalents per 100 g and having a weight-average molecular weight of 2,000 to 100,000, and the toner particles are spherical and have an average particle diameter of 3 to 13 μm. The toner is produced by a process comprising adding an aqueous medium to a dispersion of at least a colorant and an anionic self-emulsifiable resin in a water-miscible organic solvent to cause phase inversion to obtain an emulsion, and separating the produced particles from the aqueous medium, followed by drying, in which the anion self-emulsifiable resin is a polyester resin having a neutral salt structure, having a total acid radical content of 2 to 50 mg equivalents per 100 g and having a weight-average molecular weight of 2,000 to 100,000.

14 Claims, 1 Drawing Sheet

TONER FOR DEVELOPING ELECTROSTATIC LATENT IMAGE AND PROCESS FOR PRODUCING THE SAME

FIELD OF THE INVENTION

This invention relates to a toner for developing an electrostatic latent image in electrophotography, electrostatic recording, electrostatic printing, etc. and a process for producing the same. More particularly, it relates to a novel toner consisting mainly of a polyester resin and a novel process for producing the same.

BACKGROUND OF THE INVENTION

Toners consisting mainly of a polyester resin as a binder have been conventionally produced by what we call a grinding method which comprises melt-kneading a solid polyester resin with pigments, etc. and grinding the mixture to particles having a volume average diameter of 6 to 12 μm.

Toner particles produced by the conventional grinding method unavoidably have an amorphous shape. In particular, small diameter toners having a volume average diameter of 8 μm or less have extremely deteriorated powder fluidity. A second problem of the toners by the grinding method consists in that the required grinding energy per unit weight drastically increases with decrease in particle size, which incurs great cost.

In the latest electrophotography there has been a tendency that the particle size of toners is getting smaller and smaller to meet the demands for improvements of image quality in terms of resolving power, gradation, and the like. In view of such tendency, the conventional grinding method involves the above-described two problems.

In the light of the above situation, various methods for producing toners without relying on grinding (non-grinding methods) have been proposed.

A so-called suspension polymerization method is typical among them. The suspension polymerization method comprises adding a radical polymerization initiator to an oily phase comprising a pigment, etc. dispersed in a vinyl monomer, suspending the oily phase in water, and causing the vinyl monomer to polymerize to obtain spherical polymer particles. In this case, as a matter of course, the main component of the resin is limited to a vinyl polymer resulting from radical polymerization.

Another type of non-grinding methods, and no more else, is the one disclosed in JP-A-4-303849 (unexamined published Japanese patent application), which comprises adding an aqueous solution containing a dispersion stabilizer, e.g., polyvinyl alcohol, and a surface active agent, e.g., sodium laurate, to a solution of a resin in a hydrophobic solvent, such as dichloromethane, to cause phase inversion, removing dichloromethane by evaporation, collecting the produced particles by filtration, washing off the dispersion stabilizer, the surface active agent, and the like which adhere to the surfaces of the particles, and drying the particles in vacuo to obtain a polyester toner.

The above method has the following disadvantages. (1) A halogenated hydrocarbon attended by a fear of toxicity is used as a hydrophobic solvent. (2) A dispersion stabilizer and a surface active agent which, as is well known in the art, give serious adverse influences on the charging characteristics of a toner if they remain on the surface of the toner even in small amounts. These additives must be completely removed by washing, but such is very difficult in practice. The smaller the toner particles, the more difficult it is to remove them by washing.

SUMMARY OF THE INVENTION

It is an object of the present invention to provide a novel polyester toner for developing an electrostatic latent image and a novel non-grinding process for producing a polyester toner without involving the problems associated with conventional non-grinding processes.

More specifically, an object of the present invention is to provide a polyester toner consisting of spherical particles of small size.

Another object of the present invention is to provide a process for producing a polyester toner which does not need use of a halogenated hydrocarbon solvent, such as dichloromethane.

A further object of the present invention is to provide a process for producing a polyester toner which does not need use of a dispersion stabilizer nor a surface active agent which is liable to remain on the toner surface and would adversely influence the charging properties.

The inventors have conducted extensive studies and, as a result, reached the present invention.

The present invention relates to a toner for developing an electrostatic latent image which contains at least a colorant and a resin, in which the resin is a polyester resin containing 2 to 50 mg equivalents of an acid radical per 100 g and having a weight-average molecular weight of 2,000 to 100,000, and the toner is spherical, preferably has a Wadell's practical sphericity of 0.95 to 1.00, and has an average particle diameter of 3 to 13 μm.

The present invention also relates to a process for producing a toner for developing an electrostatic latent image, which comprises the steps of adding an aqueous medium to a dispersion of at least a colorant and an anionic self-emulsifiable resin in an organic solvent to cause phase inversion to obtain an emulsion, and separating the produced particles from the aqueous medium, followed by drying, in which the anionic self-emulsifiable resin is a polyester resin having a neutral salt structure, the polyester resin having a total acid radical content of 2 to 50 mg equivalents per 100 g and having a weight-average molecular weight of 2,000 to 100,000.

In a preferred embodiment of the present invention, a polybasic acid component providing the polyester resin is an aromatic carboxylic acid, preferably terephthalic acid, and a polyhydric alcohol component providing the polyester resin is an aromatic diol and/or an alicyclic diol, preferably a compound represented by formula (I) shown below as aromatic diol and/or 1,4-cyclohexanedimethanol as alicyclic diol:

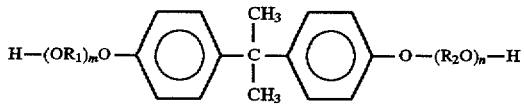

(I)

wherein $R_1$ and $R_2$ which may be the same or different, each represents an alkylene group having 2 or 3 carbon atoms; and m and n are each an integer of 1 or more, satisfying $2 \leqq m+n \leqq 4$.

In another preferred embodiment of the present invention, the organic solvent is a water-miscible organic solvent, preferably tetrahydrofuran.

In a still another preferred embodiment of the present invention, a base providing a polyester resin with a neutral salt structure is ammonia.

In a further preferred embodiment of the present invention, the aqueous medium contains an acid.

In a still further preferred embodiment of the present invention, the colorant is a color pigment having no such ionic group as strongly exhibits hydrophilic properties in its structure, particularly one or more pigments selected from the group consisting of methylquinacridone pigments, phthalocyanine pigments, and Benzidine Yellow pigments.

The present invention provides a polyester toner having a specific particle size and a specific degree of sphericity and a process for easily producing a polyester toner having a small particle size and a spherical particle shape without using any dispersion stabilizer nor any surface active agent. The toner of the present invention exhibits an excellent rise of charge quantity and excellent stability for some unknown reasons. The inventors assume that carboxyl groups are localized in the vicinities of the surface of toner particles when the particles are formed by the phase inversion, and therefore the toner is efficiently charged.

DETAILED DESCRIPTION OF THE INVENTION

Figure 1:
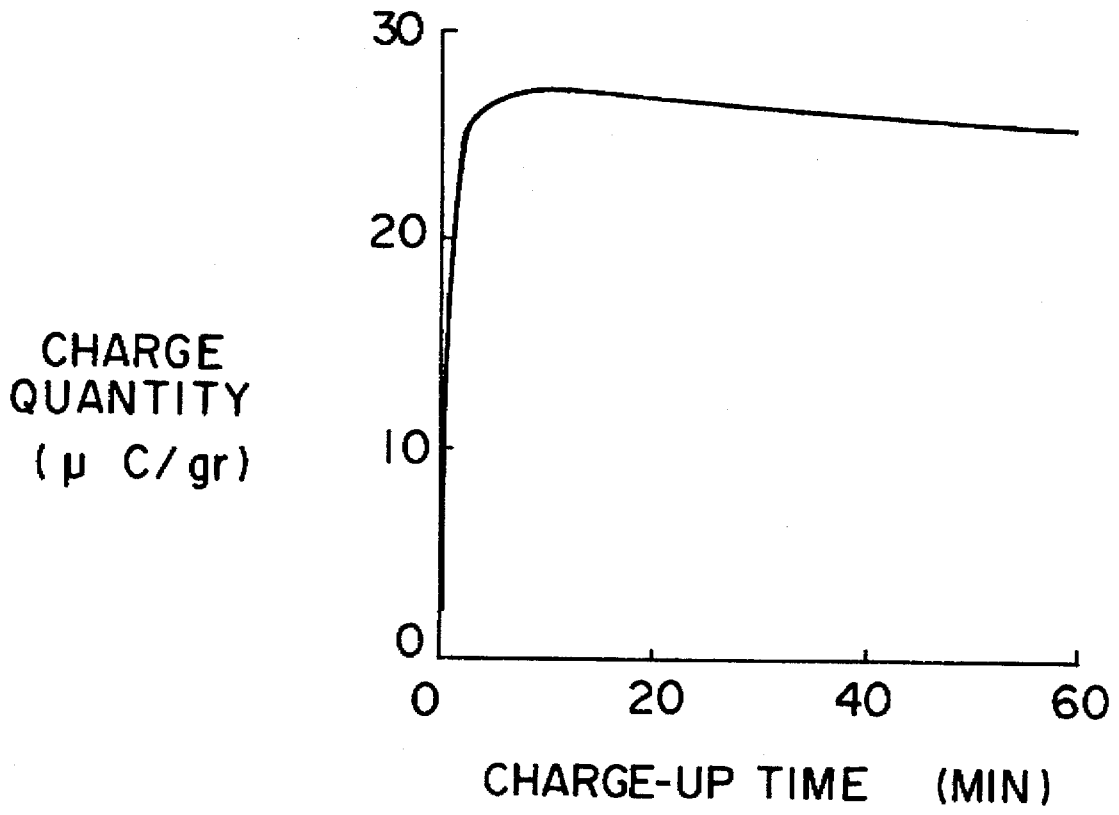
FIG. 1 is a graph showing the change of charge quantity of a toner as measured with a blow-off powder charge measuring apparatus.

The toner according to the present invention consists of spherical particles preferably having a Wadell's practical sphericity of 0.95 to 1.00.

The terminology "Wadell's practical sphericity" as used herein means a ratio of a diameter of a circle having the same area as the projected area of a particle to a diameter of the minimal circle circumscribing the projected image of the particle. An aliquot of a toner is spread on a slide glass in such a manner that the individual toner particles may not contact with each other nor overlap each other. The toner particles are displayed on a CRT screen under a 500× microscope by means of Ruzex 450 manufactured by Nippon Regulator K.K. As long as the individual particles are isolated from each other, Ruzex 450 allows free choice of particles and measurement of their projected area, from which the diameter of a circle having the same area can be calculated for each particle. On the other hand, the image on the CRT screen is photographed, a minimal circle circumscribing the projected image of the particle is constructed, and the diameter of the circle is obtained. The measurement is made for 100 particles randomly chosen to obtain the mean value as a Wadell's practical sphericity.

If the Wadell's practical sphericity is less than 0.95, the toner has poor fluidity.

The toner of the present invention has an average particle size of 3 to 13 μm.

The terminology "average particle size" as used herein means a 50% volume average particle size as measured with a Coulter counter which is usually used in toner manufacturing. For particular use in full color copying machines, small diameter toners having an average particle size of 3 to 8 μm are preferred. If the average particle size is less than 3 μm, the fluidity is deteriorated. If it exceeds 13 μm, the image resolving power is reduced.

The polyester resin having a neutral salt structure which can be used in the present invention is a polyester composed of a polyester skeleton having a total acid radical content of 2 to 50 mg equivalents per 100 g of the resin and having part or all of the acid radicals thereof neutralized with an organic or inorganic base. A proportion of base-neutralized acid radicals in the total acid radicals (i.e., degree of neutralization), namely, a content of a neutral salt structure, decides the self-emulsifiability, which ultimately decides the average particle size of a toner.

According to the inventors' study, the higher the total acid radical content and the higher the degree of neutralization, the smaller the average particle size of the toner.

The inorganic base to be used for neutralization includes hydroxides, carbonates or acetates of alkali metals (e.g., sodium hydroxide, potassium hydroxide or lithium hydroxide) and aqueous ammonia. The organic base to be used includes alkylamines, such as methylamine, dimethylamine, trimethylamine, ethylamine, diethylamine, and triethylamine; and alkanolamines, such as diethanolamine. Aqueous ammonia is particularly preferred; for it can be removed, for the most part, in the subsequent steps of reverse neutralization and drying hereinafter described and therefore gives little adverse influence. There is a fear that the other inorganic bases may have adverse influences on charging properties if they remain as ions in the inside of toner particles. The organic amines are unfavorable for the health, if any remains in the inside of toner particles.

As stated above, the polyester resin is required to have a total acid radical content of 2 to 50 mg equiv./100 g, preferably 5 to 30 mg equiv./100 g, still preferably 5 to 20 mg equiv./100 g. In the case of using a polyester resin as in the present invention as compared to the case of using a vinyl polymer, toner particles can be produced in the above-described with far less total acid radical content. This is because, the inventors assume, the polyester has a rather lower molecular weight; so it must have considerably higher solubility and affinity in/with water than the vinyl polymer. And yet, should the total acid radical content be less than 2 mg equiv./100 g, the toner obtained by phase inversion would have an average particle size exceeding 12 μm however the degree of neutralization is adjusted. On the other hand, should the total acid radical content be more than 50 mg equiv./100 g, the particle size would be no more than 2 μm however the degree of neutralization is adjusted. Anyway the resulting toner is unsuitable for general use in the state of the art.

The polyester resin having a neutral salt structure should have a weight-average molecular weight of 2,000 to 100,000. For use as full color toner, an average molecular weight of from 5,000 to 20,000 is preferred. If the weight-average molecular weight is less than 2,000, the loss of the resin due to dissolving in water during phase inversion increases, and the resin is too brittle to serve as toner binder, resulting in poor fixing onto an OHP sheet. If the weight-average molecular weight exceeds 100,000, such a high viscosity at the time of phase inversion makes it difficult to obtain particles having an average particle size of 13 μm or smaller.

The above-mentioned polyester having a neutral salt structure can be prepared as follows.

A base (non-neutralized) polyester is prepared by general dehydration polycondensation reaction between a polybasic acid and a polyhydric alcohol in the presence of a catalyst with or without a solvent. Part of the polybasic acid may be replaced with a methyl ester thereof to conduct de-methanolization polycondensation reaction.

Examples of useful polybasic acids include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as maleic anhydride, fumaric acid, succinic acid, alkenylsuccinic anhydride, and adipic acid; and alicyclic carboxylic acids, such as cyclohexanedicarboxylic acid. These polybasic acids may be used either individually or as a mixture of two or more thereof. Of these polybasic acids aromatic carboxylic acids are preferred. Terephthalic acid is still preferred.

Examples of useful polyhydric alcohols include aliphatic diols, such as ethylene glycol, propylene glycol, butanediol, hexanediol, neopentyl glycol, and glycerol; alicyclic diols, such as cyclohexanediol, cyclohexanedimethanol, and hydrogenated bisphenol A; and aromatic diols, such as an ethylene oxide adduct of bisphenol A and a propylene oxide adduct of bisphenol A. Aromatic diols and alicyclic diols are preferred of them, with aromatic diols being still preferred. These polyhydric alcohols may be used either individually or as a combination of two or more thereof. Where an aromatic diol is combined with an alicyclic diol, 1,4-cyclohexanedimethanol is a recommended alicyclic diol. It is particularly recommended to use 1,4-cyclohexanedimethanol (A) and a glycol (B) represented by formula (I) at an (A):(B) molar ratio of 35:65 to 65:35, preferably 40:60 to 60:40.

For use as toner for full color copying machines or full color printers, the polyester resin preferably has a glass transition point of 55° to 75° C., still preferably 60° to 70° C. Toners using a binder resin having a glass transition point of lower than 55° C. tend to have poor resistance to thermal agglomeration, and those using a binder resin having a glass transition point exceeding 75° C. tend to have poor fixability.

For use as toner for full color copying machines or full color printers, the polyester resin preferably has a melt viscosity of $1\times10^4$ to $1\times10^6$ poise, still preferably $5\times10^4$ to $5\times10^5$ poise, at 100° C. If the melt viscosity of the resin is lower than $1\times10^4$ poise at 100° C., paper with a toner on tends to cling to a fixing heat roll or an offset phenomenon tends to occur, while depending on the silicone oil feed to the roll. .if the melt viscosity exceeds $1\times10^6$ poise, melt mixing of cyan, magenta, yellow and black toners transferred on paper at the time of fixing tends to be insufficient, resulting in color formation deficiency.

The acid radical content of a polyester can be adjusted by control of the terminal carboxyl group, which can be done by adjusting the compounding ratio of the polybasic acid and the polyhydric alcohol and the rate of reaction therebetween. Further, a polyester having a carboxyl group in the main chain thereof can be obtained by using trimellitic anhydride as a polybasic acid component, The polycondensation reaction is terminated when the acid value and the softening point reach the respective prescribed value, and a prescribed amount of a solvent is slowly added from the top of a condenser while stirring and cooling. Finally, a prescribed amount of an organic or inorganic base is added thereto to conduct neutralization to obtain a polyester having a neutral salt structure.

In the present invention, the binder resin preferably consists solely of the above-mentioned specific polyester. If desired, other resins may be used in combination in a proportion of less than 40% by weight based on the total resin. Useful other resins include a styrene-acrylate resin, an epoxy resin, a styrene-butadiene resin, and a petroleum resin. Such being the case, the acid radical content in the total resin must range from 2 to 50 mg equiv./100 g, and the weight-average molecular weight of the total resin must fall within a range of from 2,000 to 100,000.

The organic solvent which can be used in the present invention includes water-miscible organic solvents, such as tetrahydrofuran (THF), methyl ethyl ketone (MEK), and ethyl acetate. Among them THF is particularly preferred for its high solubility for the polyester of the present invention. THF is preferably used alone for ease of recovery and reuse, but other solvents may be used in combination in a minor proportion if desired. For example, a small amount of alcohols, ketones, ethers, esters or hydrocarbon solvents may be used in combination with THF. Anyway, low-boiling solvents which are easily removed in the subsequent step are preferred.

While all kinds of pigments can be used as colorant in principle, examples of suitable pigments include Hansa Yellow 10G, Hansa Yellow G, Benzidine Yellow G, Benzidine Yellow GR, Permanent Orange, Lithol Fast Orange 3GR, Permanent Orange GTR, Vulcan Fast Orange GG, Permanent Red 4R, Fire Red, p-chloro-o-nitroaniline red, Brilliant Fast Scarlet, Brilliant Carmine BS, Pyrazolone Red, Lithol Red, Lake Red C, Lake Red D, Brilliant Scarlet G, Permanent Red F5R, Brilliant Carmine 6B, Pigment Scarlet 3B, Rhodamine Lake (Fanal Color), Alizarine Lake, Toluidine Maroon, Permanent Bordeaux F2R, Helio Bordeaux BL, Bordeaux 10B, BON Maroon Light, BON Maroon Medium, Thioingo Maroon, Perylene Red, Permanent Red BL, Permanent Pink E (a quinacridone pigment produced by Farweke Hoechst A. G. (FH)), Phthalocyanine Blue, Fast Sky Blue, Indanthrene Blue RS, Pigment Green B, Naphthol Green B, Green Gold, Phthalocyanine Blue, Aniline Black, and carbon black. Naphthol Yellow S Lake, Quinoline Yellow Lake, Prussian orange, Peacock Blue Lake, Acid Green Lake, etc. are not favorable in the present invention; for they are less resistant to water and liable to dissolve in water slightly, making the particle formation system of the emulsion after phase inversion instable. Para Red, Bordeaux 5B, Alkali Blue Toner, etc. are not favorable in the present invention; for they are less resistant to solvent and liable to dissolve in an organic solvent slightly, making the particle formation system instable.

While not limiting, the most preferred pigments in the present invention are Benzidine Yellow series as yellow pigment; quinacridone pigments as red pigment; and Phthalocyanine Blue as blue pigment.

Any known pigment dispersing machine, such as a ball mill, a sand mill, an agitator mill, an attritor, a kneader, and the like, can be used for mixing and dispersing the pigment in the polyester resin.

The pigment may be dispersed in the resin before the base polyester is neutralized, and neutralization for introduction of a neutral salt structure can follow. A resinous component once isolated in solid state may be melt-kneaded with the pigment, followed by addition of the solvent. In this case, introduction of a neutral salt structure may either precede or follow the melt-kneading. Further, the pigment may be dispersed in a portion of the resin to prepare a masterbatch.

The pigment content in the toner is 2 to 10% by weight. If desired, two or more pigments may be used in combination. The toner may further contain known additives for toners, such as charge control agents, lubricants, and offset preventives. The toner of the present invention may contain a magnetic material, such as magnetite, to provide a one-component magnetic toner.

The aqueous medium causing phase inversion is basically water. A small amount of an acid is preferably added to water as aqueous medium. Addition of a small amount of an acid is effective to minimize the loss due to dissolving in water at the time of phase inversion. Useful acids include hydrochloric acid, sulfuric acid, nitric acid, carbonic acid, sulfurous acid, and nitrous acid. An aqueous acid solution diluted to about 0.01N can be used as aqueous medium.

On addition of a prescribed amount of an aqueous medium dropwise to the colorant/resin dispersion while stirring, phase inversion takes place at a certain point to form spherical particles containing the pigment. The organic solvent is then distilled off under reduced pressure, and the toner stock particles are collected by filtration. The wet filter cake is washed with water, and about 0.01N diluted hydrochloric acid is poured thereon whereby the neutral salt structure on the surface of the particles is reversely neutralized into acid form. The particles are thoroughly washed with water again, followed by drying to obtain toner stock. Thereafter, the toner stock is classified, and external additives, such as hydrophobic silica, can be added thereto to give a toner in the same manner as in the conventional grinding method.

The present invention is now illustrated in greater detail with reference to Examples, but it should be understood that the present invention is not deemed to be limited thereto. Unless otherwise indicated, all the parts and percents are given by weight.

SYNTHESIS EXAMPLE 1

Synthesis of Polyester having Neutral Salt Structure

In a flask equipped with a stirrer, a thermometer, a tube for $N_2$ introduction, and a fractionating column were charged 576 parts (4 mol) of cyclohexanedimethanol and 1950 parts (6 mol) of bisphenol A ethylene oxide (2.2 mol) adduct. Then, 1494 parts (9 mol) of terephthalic acid and 4 parts of dibutyltin oxide were charged. The mixture was heated with stirring in a nitrogen gas stream to conduct dehydration condensation at 240° C., taking care not to distill the starting monomers. If any was distilled off, the loss was made up for so that the resin produced may keep the charged composition. The reaction was continued until the acid value became 8 mg·KOH/g (corresponding to a total acid radical content of 14.3 mg equiv./100 g), nitrogen gas feed was ceased, and the reaction system was cooled to 160° C. with stirring. The fractionating column was displaced with a Dimroth condenser, and 5551 parts of THF was slowly added from the top of the condenser while further cooling with stirring. When the temperature dropped to 20° C., 25.2 parts of 25% aqueous ammonia was added thereto to conduct neutralization, followed by cooling to room temperature, to give a THF solution of a polyester having a neutral salt structure (degree of neutralization: 70%) (resinous content: 40%). The weight-average molecular weight was 9,500 as measured by gel-permeation chromatography (GPC). The resulting resin had a glass transition point of 64° C. as measured with a differential scanning calorimeter DSC 220C manufactured by Seiko Denshi Kogyo K.K. at a rate of temperature rise of 10° C./min according to a second run method and a melt viscosity of $1.3\times10^5$ poise at 100° C. as measured with a flow tester CFT-500 manufactured by Shimadzu Corporation at a rate of temperature rise of 5° C./min.

SYNTHESIS EXAMPLE 2

Synthesis of Polyester having Neutral Salt Structure

In a flask equipped with a stirrer, a thermometer, a tube for $N_2$ introduction, and a fractionating column were charged 1777 parts (5 mol) of bisphenol A propylene oxide (2.2 mol) adduct and 1626 parts (5 mol) of bisphenol A ethylene oxide (2.2 mol) adduct. Then, 1494 parts (9 mol) of terephthalic acid and 4 parts of dibutyltin oxide were charged. The mixture was heated with stirring in a nitrogen stream to conduct dehydration condensation at 240° C., taking care not to distill the starting monomers. If any was distilled off, the loss was made up for so that the resin produced may keep the charged composition. The reaction was continued until the acid value became 4 mg·KOH/g (corresponding to a total acid radical content of 7.2 mg equiv./100 g), nitrogen gas feed was ceased, and the reaction system was cooled to 160° C. with stirring. The fractionating column was displaced with a Dimroth condenser, and 6861 parts of THF was slowly added from the top of the condenser while further cooling with stirring. When the temperature dropped to 20° C., 22.3 parts of 25% aqueous ammonia was added thereto to conduct neutralization, followed by cooling to room temperature, to give a THF solution of a polyester having a neutral salt structure (degree of neutralization: 100%) (resinous content: 40%). The weight-average molecular weight was 13,000 as measured by GPC. The resulting resin had a glass transition point of 68° C., as measured in the same manner as in Synthesis Example 1, and a melt viscosity of $2.1\times10^5$ poise at 100° C. as measured in the same manner as in Synthesis Example 1.

SYNTHESIS EXAMPLE 3

Synthesis of Polyester having Neutral Salt Structure

In a flask equipped with a stirrer, a thermometer, a tube for $N_2$ introduction, and a fractionating column were charged 1777 parts (5 mol) of bisphenol A propylene oxide (2.2 mol) adduct and 1626 parts (5 mol) of bisphenol A ethylene oxide (2.2 mol) adduct. Then, 1577 parts (9.5 mol) of terephthalic acid and 4 parts of dibutyltin oxide were charged. The mixture was heated with stirring in a nitrogen stream to conduct dehydration condensation at 240° C., taking care not to distill the starting monomers. If any was distilled off, the loss was made up for so that the resin produced may keep the charged composition. The reaction was continued until the acid value became 17.1 mg·KOH/g (corresponding to a total acid radical content of 30.6 mg equiv./100 g), nitrogen gas feed was ceased, and the reaction system was cooled to 160° C. with stirring. The fractionating column was displaced with a Dimroth condenser, and 5625 parts of THF was slowly added from the top of the condenser while further cooling to 50° C. with stirring. At a temperature of 50° C., 43 parts of triethylamine was added thereto to conduct neutralization, followed by cooling to room temperature, to give a THF solution of a polyester having a neutral salt structure (degree of neutralization: 30%) (resinous content: 40%). The weight-average molecular weight was 9,500 as measured by GPC. The resulting resin had a glass transition point of 63° C., as measured in the same manner as in Synthesis Example 1, and a melt viscosity of $1.0\times10^5$ poise at 100° C. as measured in the same manner as in Synthesis Example 1.

COMPARATIVE SYNTHESIS EXAMPLE 1

Synthesis of Polyester Having no Neutral Salt Structure

In a flask equipped with a stirrer, a thermometer, a tube for $N_2$ introduction, and a fractionating column were charged 576 parts (4 mol) of cyclohexanedimethanol and 1950 parts (6 mol) of bisphenol A ethylene oxide (2.2 mol) adduct. Then, 1494 parts (9 mol) of terephthalic acid and 4 parts of dibutyltin oxide were charged. The mixture was heated with stirring in a nitrogen stream to conduct dehydration condensation at 240° C., taking care not to distill the starting monomers. If any was distilled off, the loss was made up for so that the resin produced may keep the charged composition. The reaction was continued until the acid value became 8 mg·KOH/g (corresponding to a total acid radical content of 14.3 mg equiv./100 g), nitrogen gas feed was ceased, and the reaction system was cooled to 160° C. with stirring. The fractionating column was displaced with a Dimroth condenser, and 5559 parts of THF was slowly added from the top of the condenser while further stirring and cooling to room temperature to give a THF solution of a polyester having no neutral salt structure (resinous content: 40%). The weight-average molecular weight was 9,300 as measured by GPC.

COMPARATIVE SYNTHESIS EXAMPLE 2

Synthesis of Polyester Having no Neutral Salt Structure

In a flask equipped with a stirrer, a thermometer, a tube for $N_2$ introduction, and a fractionating column were charged 576 parts (4 mol) of cyclohexanedimethanol and 1950 parts (6 mol) of bisphenol A ethylene oxide (2.2 mol) adduct. Then, 1494 parts (9 mol) of terephthalic acid and 4 parts of dibutyltin oxide were charged. The mixture was heated with stirring in a nitrogen stream to conduct dehydration condensation at 240° C., taking care not to distill the starting monomers. If any was distilled off, the loss was made up for so that the resin produced may keep the charged composition. The reaction was continued until the acid value became 8 mg·KOH/g (corresponding to a total acid radical content of 14.3 mg equiv./100 g), nitrogen gas feed was ceased, and the reaction system was cooled to 160° C. with stirring. The fractionating column was displaced with a Dimroth condenser, and 5559 parts of dichloromethane was slowly added from the top of the condenser while further stirring and cooling to room temperature to give a dichloromethane solution of a polyester having no neutral salt structure (resinous content: 40%). The weight-average molecular weight was 9,600 as measured by GPC.

COMPARATIVE SYNTHESIS EXAMPLE 3

Synthesis of Polyester Having Less Than 2 mg equiv./100 g of Total Acid Radical Content In a flask equipped with a stirrer, a thermometer, a tube for $N_2$ introduction, and a fractionating column were charged 576 parts (4 mol) of cyclohexanedimethanol and 1950 parts (6 mol) of bisphenol A ethylene oxide (2.2 mol) adduct. Then, 1411 parts (8.5 mol) of terephthalic acid and 4 parts of dibutyltin oxide were charged. The mixture was heated with stirring in a nitrogen stream to conduct dehydration condensation at 240° C., taking care not to distill the starting monomers. If any was distilled off, the loss was made up for so that the resin produced may keep the charged composition. The reaction was continued until the acid value became 0.53 mg·KOH/g (corresponding to a total acid radical content of 0.94 mg equiv./100 g), nitrogen gas feed was ceased, and the reaction system was cooled to 160° C. with stirring. The fractionating column was displaced with a Dimroth condenser, and 5455 parts of THF was slowly added from the top of the condenser while further stirring and cooling. When the mixture was cooled to 50° C., 3.43 parts of triethylamine was added thereto to conduct neutralization, followed by further cooling to room temperature to give a THF solution of a polyester having a neutral salt structure (degree of neutralization: 100%) (resinous content: 40%). The weight-average molecular weight was 9,400 as measured by GPC.

COMPARATIVE SYNTHESIS EXAMPLE 4

Synthesis of Polyester Having More Than 50 mg equiv./100 g of Total Acid Radical Content In a flask equipped with a stirrer, a thermometer, a tube for $N_2$ introduction, and a fractionating column were charged 576 parts (4 mol) of cyclohexanedimethanol and 1950 parts (6 mol) of bisphenol A ethylene oxide (2.2 mol) adduct. Then, 1494 parts (9 mol) of terephthalic acid and 4 parts of dibutyltin oxide were charged. The mixture was heated with stirring in a nitrogen stream to conduct dehydration condensation at 240° C. In the course of the reaction, 332 parts (2 mol) of isophthalic acid was added. During the reaction, care was taken so as not to distill the starting monomers. If any was distilled off, the loss was made up for so that the resin produced may keep the charged composition. The reaction was continued until the acid value became 42 mg·KOH/g (corresponding to a total acid radical content of 75 mg equiv./100 g), nitrogen gas feed was ceased, and the reaction system was cooled to 160° C. with stirring. The fractionating column was displaced with a Dimroth condenser, and 6071 parts of THF was slowly added from the top of the condenser while further stirring and cooling. When the mixture was cooled to 50° C., 36 parts of triethylamine was added thereto to conduct neutralization, followed by further cooling to room temperature to give a THF solution of a polyester having a neutral salt structure (degree of neutralization: 20%) (resinous content: 40%). The weight-average molecular weight was 7,800 as measured by GPC.

EXAMPLE 1

To 242.5 parts of the resin solution prepared in Synthesis Example 1 was added 3 parts of a phthalocyanine pigment (KET Blue 104 (C.I. Pigment Blue 15-3), prepared by Dainippon Ink and Chemicals, Inc.), and the mixture was kneaded in a ball mill for 24 hours. THF was added to make up for the loss during the kneading. In a 300 ml flask was charged 100 parts of the mixture, and 100 parts of deionized water was added thereto dropwise over 1 hour while stirring with a turbine blade at 600 rpm. THF was removed by distillation under reduced pressure while maintaining the contents of the flask at 40° C., and the residue was filtered The wet cake (toner stock) was washed with water, and diluted hydrochloric acid was added thereto for reverse neutralization to convert the neutral salt structure on the surface of the toner particles to an acid form, followed by thoroughly washing with water and drying to obtain toner stock particles in a yield of 90%.

The toner stock particles were classified by means of a classifier (classification yield: 92%) and dry blended with 0.2% of hydrophobic silica (R-972, produced by Nippon Aerosil K.K.) to obtain a blue toner having an average particle size of 6.8 μm and a Wadell's practical sphericity of 0.98.

Five parts of the resulting toner and 95 parts of a ferrite carrier having an average particle size of 80 μm were mixed in a 1 l-volume polyethylene bottle at 100 rpm for 1 hour to prepare a developer. The change in charge quantity with the mixing time was measured with a blow-off powder charge measuring apparatus TB-200 to obtain a charge-up characteristic graph of FIG. 1. It was confirmed that the amount of charges rises rapidly immediately after the start of mixing, indicating satisfactory negative chargeability.

When preserved at 50° C. for 24 hours, the toner underwent no agglomeration nor blocking which would cause troubles in practical use, showing satisfactory preservation stability.

A development test of the resulting toner was carried out by using a commercially available copying machine using a selenium photoreceptor drum from which the heat roll fixing part was removed. Fixing to paper was conducted in a constant temperature drier at 150° C. As a result, clear blue images free from fog or blurs were obtained.

EXAMPLE 2

Magenta toner stock was prepared in the same manner as in Example 1, except for replacing the phthalocyanine pigment used in Example 1 with 3 parts of a quinacridone pigment (KET RED 309 (C.I. Pigment Red 122) produced by Dai-Nippon Ink and Chemicals, Inc.). The yield of the stock was 91%.

A toner having an average particle size of 7.5 μm and a Wadell's practical sphericity of 0.97 was prepared using the resulting toner stock in the same manner as in Example 1. The classification yield was as high as 93%. The resulting toner was tested by a preservation stability test and a development test in the same manner as in Example 1. As a result, the toner exhibited satisfactory preservation stability and provided clear magenta images free from fog or blurs.

EXAMPLE 3

Toner stock was prepared in the same manner as in Example 2, except for replacing the quinacridone pigment used in Example 2 with 3 parts of Brilliant Carmine 6B (KET RED 307 (C.I. Pigment Red 57-1) produced by Dai-Nippon Ink and Chemicals, Inc.). The pigment partly dissolved in the solvent so that the filtrate was colored in red. The yield of the stock was 85%.

A toner having an average particle size of 9 μm and a Wadell's practical sphericity of 0.96 was prepared using the resulting toner stock in the same manner as in Example 1. The classification yield was 75%. The resulting toner was tested by a preservation stability test and a development test in the same manner as in Example 1. As a result, the toner exhibited satisfactory preservation stability and provided clear magenta images free from fog or blurs.

EXAMPLE 4

Toner stock was prepared in the same manner as in Example 1, except for replacing the phthalocyanine pigment used in Example 1 with 3 parts of a benzidine pigment (KET YELLOW 403 (C.I. Pigment Yellow 17) produced by Dai-Nippon Ink and Chemicals, Inc.), in a yield of 91%.

A toner having an average particle size of 7.0 μm and a Wadell's practical sphericity of 0.97 was prepared using the resulting toner stock in the same manner as in Example 1. The classification yield was 90%. The resulting toner was tested by a preservation stability test and a development test in the same manner as in Example 1. As a result, the toner exhibited satisfactory preservation stability and provided clear yellow images free from fog or blurs.

EXAMPLE 5

Black toner stock was prepared in the same manner as in Example 1, except for replacing the phthalocyanine pigment used in Example 1 with 5 parts of carbon black (Elftex 8 produced by Cablack Co.) in a yield of 89%.

A toner having an average particle size of 6.7 μm and a Wadell's practical sphericity of 0.98 was prepared using the resulting toner stock in the same manner as in Example 1. The classification yield was 91%. The resulting toner was tested by a preservation stability test and a development test in the same manner as in Example 1. As a result, the toner exhibited satisfactory preservation stability and provided clear black images free from fog or blurs.

EXAMPLE 6

Blue toner stock was prepared in the same manner as in Example 1, except for replacing the resin solution of Synthesis Example 1 with the resin solution of Synthesis Example 2 and replacing deionized water to be added dropwise with 0.01N diluted hydrochloric acid. The yield of the toner stock was as high as 96%.

A toner having an average particle size of 9.0 μm and a Wadell's practical sphericity of 0.95 was prepared using the resulting toner stock in the same manner as in Example 1. The classification yield was 89%. The resulting toner was tested by a preservation stability test and a development test in the same manner as in Example 1. As a result, the toner exhibited satisfactory preservation stability and provided clear blue images free from fog or blurs.

EXAMPLE 7

Yellow toner stock was prepared in the same manner as in Example 4, except for replacing the resin solution of Synthesis Example 1 with the resin solution of Synthesis Example 2. The yield of the toner stock was 90%.

A toner having an average particle size of 6.8 μm and a Wadell's practical sphericity of 0.96 was prepared using the resulting toner stock in the same manner as in Example 1. The classification yield was 92%. The resulting toner was tested by a preservation stability test and a development test in the same manner as in Example 1. As a result, the toner exhibited satisfactory preservation stability and provided clear yellow images free from fog or blurs.

EXAMPLE 8

Magenta toner stock was prepared in the same manner as in Example 1, except for replacing the resin solution of Synthesis Example 1 with the resin solution of Synthesis Example 3 and replacing the phthalocyanine pigment with 3 parts of a quinacridone pigment (KET RED 309 (C.I. Pigment Red 122) produced by Dai-Nippon Ink and Chemicals, Inc.). The yield of the toner stock was 85%.

A toner having an average particle size of 7.5 μm and a Wadell's practical sphericity of 0.97 was prepared using the resulting toner stock in the same manner as in Example 1. The classification yield was 92%. The resulting toner was tested by a preservation stability test and a development test in the same manner as in Example 1. As a result, the toner exhibited satisfactory preservation stability and provided clear magenta images free from fog or blurs.

EXAMPLE 9

To 125 parts of the resin solution prepared in Synthesis Example 1 was added 50 parts of magnetite (Mapico Black BL-500 produced by Titan Kogyo K.K.), and 75 parts of THF was further added thereto. The mixture was kneaded in a ball mill for 24 hours, and THF was added to make up for the loss during the kneading. In a 300 ml flask was charged 100 parts of the mixture, and 100 parts of deionized water was added thereto dropwise over 1 hour while stirring with a turbine blade at 600 rpm. THF was removed by distillation under reduced pressure while maintaining the contents of the flask at 40° C., and the residue was filtered. The wet cake (toner stock) was washed with water, and diluted hydrochloric acid was added thereto for reverse neutralization to convert the neutral salt structure on the surface of the toner particles to an acid form, followed by thoroughly washing with water and drying to obtain toner stock particles in a yield of 83%.

The toner stock particles were classified by means of a classifier (classification yield: 89%) and dry blended with 0.2% of hydrophobic silica (R-972, produced by Nippon Aerosil K.K.) to obtain a magnetic toner having an average particle size of 9.5 μm and a Wadell's practical sphericity of 0.95.

When preserved at 50° C. for 24 hours, the toner underwent no agglomeration nor blocking which would cause troubles in practical use, showing satisfactory preservation stability.

A development test of the resulting toner was carried out by using a commercially available copying machine using a selenium photoreceptor drum from which the heat roll fixing part was removed. Fixing to paper was conducted in a constant temperature drier at 150° C. As a result, clear black images free from fog or blurs were obtained.

COMPARATIVE EXAMPLE 1

Deionized water was added dropwise to a dispersion of a resin solution and a pigment in the same manner as in Example 1, except for replacing the resin solution of Synthesis Example 1 with the resin solution of Comparative Synthesis Example 1, i.e., a THF solution of a polyester having no neutral salt structure, but no particles were formed.

COMPARATIVE EXAMPLE 2

Deionized water was added dropwise to a dispersion of a resin solution and a pigment in the same manner as in Example 1, except for replacing the resin solution of Synthesis Example 1 with the resin solution of Comparative Synthesis Example 2, i.e., a dichloromethane solution of a polyester having no neutral salt structure, but no particles were formed.

COMPARATIVE EXAMPLE 3

Deionized water was added dropwise to a dispersion of a resin solution and a pigment in the same manner as in Example 1, except for replacing the resin solution of Synthesis Example 1 with the resin solution of Comparative Synthesis Example 3. The particles formed were as coarse as having an average particle size of 30 μm, which were of no use as a toner. The Wadell's practical sphericity of the particles was 0.90.

COMPARATIVE EXAMPLE 4

0.01N Dilute hydrochloric acid was added dropwise in the same manner as in Example 4, except for using the resin solution of Comparative Synthesis Example 4. The yield of toner stock particles was as low as 30 parts (75%).

A toner having an average particle size of 5.6 μm and a Wadell's practical sphericity of 0.75 was obtained from the toner stock in the same manner as in Example 1. The classification yield was 87%. As a result of the same preservation stability test (50° C. ×24 hours) as in Example 1, the toner was found to undergo agglomeration to such a degree as will cause troubles in practical use.

As has been fully described, the present invention provides a polyester color toner having a small particle size and a high degree of sphericity with extreme ease without using a dispersion stabilizer or a surface active agent. The resulting toner exhibits a rapid rise in charging and excellent stability.

While the invention has been described in detail and with reference to specific embodiments thereof, it will be apparent to one skilled in the art that various changes and modifications can be made therein without departing from the spirit and scope thereof.

What is claimed is:

1. A toner for developing an electrostatic latent image which contains at least a colorant and a resin, in which said resin is a polyester resin having a total acid radical content of 2 to 50 mg equivalents per 100 g and having a weight-average molecular weight of 2,000 to 100,000, and said toner is spherical and has an average particle diameter of 3 to 13 μm.

2. A toner according to claim 1, wherein said toner has a Wadell's practical sphericity of 0.95 to 1.00.

3. A toner according to claim 1, wherein said polyester resin is a polyester resin obtained by reacting an aromatic carboxylic acid as a polybasic acid component with an aromatic diol represented by formula (I) and/or an alicyclic diol as a polyhydric alcohol component:

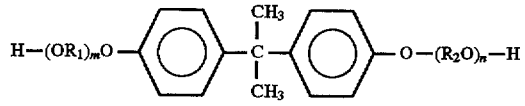

(I)

wherein $R_1$ and $R_2$ which may be the same or different, each represents an alkylene group having 2 or 3 carbon atoms; and m and n are each an integer of 1 or more, satisfying $2 \leqq m+n \leqq 4$.

4. A toner according to claim 3, wherein said alicyclic diol is 1,4-cyclohexanedimethanol.

5. A toner according to claim 3, wherein said aromatic carboxylic acid is terephthalic acid.

6. A toner according to claim 1, wherein said colorant is at least one pigment selected from the group consisting of methylquinacridone pigments, phthalocyanine pigments, and Benzidine Yellow pigments.

7. A process for producing a toner for developing an electrostatic latent image, which comprises the steps of adding an aqueous medium to a dispersion of at least a colorant and an anionic self-emulsifiable resin in a water-miscible organic solvent to cause phase inversion to obtain an emulsion, separating the produced particles from the aqueous medium, and drying the particles, in which said anion self-emulsifiable resin is a polyester resin having a neutral salt structure, said polyester resin having a total acid radical content of 2 to 50 mg equivalents per 100 g and having a weight-average molecular weight of 2,000 to 100,000.

8. A process according to claim 7, wherein said polyester resin is a polyester resin obtained by reacting an aromatic carboxylic acid as a polybasic acid component with an aromatic diol represented by formula (I) and/or an alicyclic diol as a polyhydric alcohol component:

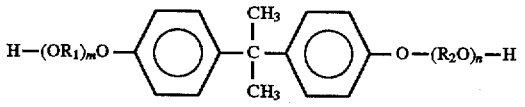

(I)

wherein $R_1$ and $R_2$ which may be the same or different, each represents an alkylene group having 2 or 3 carbon atoms; and m and n are each an integer of 1 or more, satisfying $2 \leqq m+n \leqq 4$.

9. A process according to claim 8, wherein said alicyclic diol is 1,4-cyclohexanedimethanol.

10. A process according to claim 8, wherein said aromatic carboxylic acid is terephthalic acid.

11. A process according to claim 7, wherein said water-miscible organic solvent is tetrahydrofuran.

12. A process according to claim 7, wherein said aqueous medium contains an acid.

13. A process according to claim 7, wherein said colorant is at least one pigment selected from the group consisting of methylquinacridone pigments, phthalocyanine pigments, and Benzidine Yellow pigments.

14. A toner according to claim 1, wherein said polyester resin is contained in an amount of at least 60% by weight based on the total resin.

* * * * *